US008449717B2

(12) United States Patent
Saetherasen

(10) Patent No.: US 8,449,717 B2
(45) Date of Patent: May 28, 2013

(54) METHOD FOR PREVENTING CLOGGING IN A STRAINER CONSTRUCTION FOR A CONTINUOUS DIGESTER

(75) Inventor: Jonas Saetherasen, Hammaro (SE)

(73) Assignee: Metso Paper Sweden AB, Sundsvall (SE)

( * ) Notice: Subject to any disclaimer, the term of this patent is extended or adjusted under 35 U.S.C. 154(b) by 147 days.

(21) Appl. No.: 13/123,294

(22) PCT Filed: Oct. 12, 2009

(86) PCT No.: PCT/SE2009/051149

§ 371 (c)(1),
(2), (4) Date: Apr. 8, 2011

(87) PCT Pub. No.: WO2010/044732

PCT Pub. Date: Apr. 22, 2010

(65) Prior Publication Data

US 2011/0203755 A1 Aug. 25, 2011

(30) Foreign Application Priority Data

Oct. 13, 2008 (SE) ..... 0802174

(51) Int. Cl.
*D21C 3/26* (2006.01)

(52) U.S. Cl.
USPC ..... 162/17; 162/18; 162/19; 162/251

(58) Field of Classification Search
USPC ..... 162/17, 18, 19, 251
See application file for complete search history.

(56) References Cited

U.S. PATENT DOCUMENTS 5,236,554 A * 8/1993 Greenwood ..... 162/238
5,662,775 A * 9/1997 Marcoccia et al. ..... 162/41

OTHER PUBLICATIONS

Parpala et al, Use of Fully Oxidized White Liquor as Alkali Source in Oxygen Based Delignification and Bleaching Stages. Presented on the Tappi webstie: http://www.tappi.org/Downloads/unsorted/UN-TITLED---pulp0144pdf.aspx.*

* cited by examiner

*Primary Examiner* — Jacob Thomas Minskey
(74) *Attorney, Agent, or Firm* — Rolf Fasth; Fasth Law Offices

(57) ABSTRACT

The method is for influencing the flow from a strainer construction in a continuous digester. In order to avoid clogging of the withdrawal compartment in the strainer construction, an additive that counteracts precipitation processes is added directly to the withdrawal compartment while the cooking fluid is withdrawn from the withdrawal compartment. The addition of chemicals can take place at the same time as the withdrawn cooking fluid is withdrawn from the digester and the strainer construction, or while the withdrawn cooking fluid is fully or partially re-circulated back to the withdrawal compartment.

10 Claims, 6 Drawing Sheets

METHOD FOR PREVENTING CLOGGING IN A STRAINER CONSTRUCTION FOR A CONTINUOUS DIGESTER

PRIOR APPLICATION

This application is a U.S. national phase application based on International Application No. PCT/SE2009/051149, filed 12 Oct. 2009 that claims priority from Swedish Patent Application No. 0802174-3, filed 13 Oct. 2008.

TECHNICAL AREA

The present invention concerns a method for influencing the flow from a strainer construction in a continuous digester where this influence is to prevent the clogging of the strainer construction while the continuous digester is in use.

BACKGROUND AND SUMMARY OF THE INVENTION

Large quantities of cooking fluid are withdrawn from the digester in the current strainer constructions in continuous digesters. With production capacities of 4,000 tonnes of pulp per day, the digesters have a diameter greater than 8 meters, and this makes it difficult to withdraw the quantities that are required. The strainers are therefore heavily loaded, and it becomes important to maintain the full withdrawal capacity of the strainers during operation. Various types of strainer construction are used, such as strainers with strainer bars, slitted strainer plates or rods. These strainer constructions are mounted in one or several rows in the wall of the digester in order to achieve the withdrawal capacity required. The strainer surfaces in these strainer rows can be located around the complete circumference of the digester, or they can be arranged such that the row of strainers is built up from strainer surfaces with blind plates between the strainer surfaces. This is common in strainer sections that have several rows of strainers in which each strainer row is displaced between rows such that strainer surfaces are constructed also in the vertical direction with strainer surfaces and blind plates between the strainer surfaces, such that a strainer section with the pattern of a chessboard is obtained.

The chemical conditions at the withdrawal position are a further complication, where various types of precipitate can be activated in the withdrawal slots of the strainer or in the withdrawal compartment.

A further complication is the risk for the withdrawal of hemicellulose or other components that contain fibres, which may clog the withdrawal compartment behind the strainers.

It is normal that a digester plant has one planned maintenance stoppage per year, and the strainer sections are inspected and cleaned during this stoppage. It has proved to be the case at these stoppages that the withdrawal compartment in the strainer construction has been largely clogged with fibre precipitations or chemical deposits known as "scaling".

A modified Kamyr digester is displayed in SE204097 in which alkali is added at the end of the cooking zone, and in which the cooking takes place in a countercurrent flow procedure. This process was developed by A. R. Sloman and was used in a digester installed in Tasmania that had a capacity of approximately 100 tonnes of pulp per day. An addition of black liquor to the withdrawal compartment took place in this system in a top separator with downward feed. This took place, however, with the aim of regulating the pressure in the digester, and the quantities added were small and depended on the pressure in the digester, being regulated by a valve 49.

A solution is displayed through U.S. Pat. No. 3,413,189 in our patent, in order to prevent the precipitation of lignin from the black liquor, in which a mixed cooking fluid is mixed with acidic pre-hydrolysate and black liquor. Extra alkali is added in this case at the centre of the digester through central pipes 55, which alkali is withdrawn to a large extent in the same position in the strainer section 15. Such large quantities of alkali are added here that the pH lies at a sufficiently high level, corresponding to a pH of 10 or 11.

Another technique applied to clean strainer sections has been to close down the withdrawal flow from the strainer such that the column of pulp that is led past the strainer section can exert a wearing effect on the slits of the strainer section, and in this manner provide abrasion of the clogging material on and in the slits. This cleaning, however, has an effect only on the outer parts of the strainer that face inwards towards the column of pulp.

The direction of the withdrawal flow in the header (the collection volume) has been changed in other techniques that are applied in order to make it possible to influence any sedimentation that has formed farthest away from the withdrawal taps. Other taps are opened in these systems in another header or at another position in this header, and the magnitude of the withdrawal flow is not affected.

A first aim of the invention is to avoid clogging of the withdrawal compartment of the strainer construction, by which measure the withdrawal capacity can be maintained for a longer period.

The digester can in this manner maintain a high withdrawal capacity during continuous operation, and it is not necessary to close down the digester or strainer section in order to clean the strainer construction.

A second aim is that measures taken to avoid clogging of the strainer construction are not to influence the cooking process of the chips in the column of pulp in the continuous digester. The solution can then be freely implemented in different continuous digesters that have problems with the clogging of digester strainers, without it being necessary to modify the cooking process.

The aims described above are achieved with a method to prevent the clogging of a strainer construction for a continuous digester.

Thus, in the method according to the invention sedimentation and the precipitation of deposits in the strainer compartment are avoided by the direct addition of an additive to the withdrawal compartment, which additive counteracts the precipitation process in the withdrawal compartment while the cooking fluid and the additive that has been added are withdrawn from the withdrawal compartment.

It is appropriate that the additive is added to the second subsidiary flow of the total flow that is withdrawn from the outlet tap, which second subsidiary flow is returned directly to the withdrawal compartment, and where the second subsidiary flow is less than or equal to the total flow. The additive can in this manner be caused to be mixed into the liquid volume in the withdrawal compartment either during recirculation or during withdrawal or during both recirculation and withdrawal of liquid from this volume of liquid.

Dissolved parts of sediment or chemicals can be bled from the strainer compartment in one advantageous embodiment that has the withdrawal of a first subsidiary flow of the total flow that is withdrawn from the outlet tap and that is led away from the strainer construction to a second location in the digestion plant or to the recovery process.

The rinsing effect of an activation of the second subsidiary flow is activated at least on regular occasions during the continuous operation of the digester when clogging in the withdrawal compartment is to be counteracted.

In one advantageous embodiment, the total flow is withdrawn from one end of the withdrawal compartment, preferably its lower part, and that the additive, preferably together with the second subsidiary flow of the total flow, is introduced into the second end of the withdrawal compartment, preferably its upper part. This is to ensure that the complete withdrawal compartment is to be rinsed through by the additive.

It is appropriate that the addition of the additive, preferably together with the second subsidiary flow, be regulated in a feedback manner that depends on a parameter that indicates the flow or the pH value of the first subsidiary flow or of the total flow.

Different additives can be relevant, depending on the type of risk of clogging that is present in any particular strainer construction.

If, for example, clogging can be caused by the precipitation of lignin as a result of a pH that is too low, an additive can be selected that influences the pH in the withdrawal space such that this is raised to a value of at least 10, preferably at least 11. Such an additive can be constituted by any one of white liquor, black liquor or alkaline filtrate from a subsequent bleaching plant, or constituted by mixtures of these.

If, for example, clogging can be caused by a temperature that is too low, an additive can be selected that is warmer that the liquid in the withdrawal compartment, and where the additive is partially or fully constituted by steam. If, for example, clogging can be caused by chemical precipitation onto the surfaces of the strainer construction, the additive can be principally constituted by a chemical that prevents the precipitation of chemical deposits. If, for example, the strainer construction is arranged at a position in the digestion plant at which the level of dissolved calcium ions is high, there is a risk for the precipitation of hard deposits (scaling) in the form of calcium carbonate. By the addition of carbon dioxide in gaseous or liquid form, the calcium carbonate can be caused to precipitate instead as crystals in the solution and can in this way accompany the liquid that is withdrawn from the strainer compartment.

Examples of the invention will be presented with the support of the embodiments described below.

DETAILED DESCRIPTION

The concept of "strainer section" will be used in the following description. The term "strainer section" is here used to denote a section of the wall of the continuous digester at which at least one row of strainers has been arranged. Each row of strainers has a dedicated withdrawal compartment external to the strainers in a conventional manner, and a dedicated header connected to the withdrawal compartment that collects withdrawn liquid before removal from either the row of strainers or the strainer section, or both.

Figure 1:
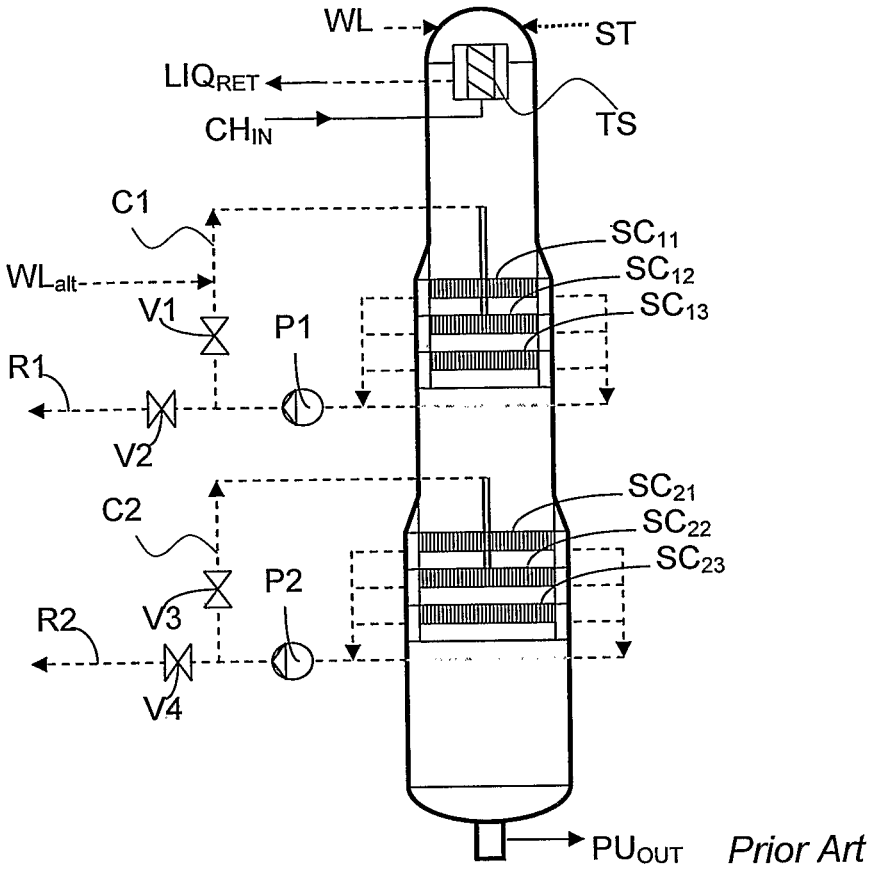
FIG. 1 shows the design of strainer sections in a continuous digester according to prior art technology.

A continuous digester is shown generally in FIG. 1 where the chips mixture $CH_{IN}$ is fed in at the top of the digester through a top separator TS. Return fluid $LIQ_{RET}$ is withdrawn from the top separator and returned to the transfer system. The top separator can, however, be omitted in certain applications.

A vapour phase digester is shown in the drawing, in which what is known as an "inverted top separator" is arranged at the top of the digester, and in which white liquor WL and steam ST, possibly also with the addition of pressurised air, are added at the top of the digester. The invention, however, can just as readily be applied to a hydraulic digester with a top separator that feeds downwards. Pulp $PU_{OUT}$ for which the cooking process has been completed is fed out from the bottom of the digester.

It is conventional that one or several strainer sections are present in the digester: two such sections are shown in the digester in FIG. 1.

Three rows of strainers $SC_{11}$, $SC_{12}$, $SC_{13}$ are located in an upper strainer section.

Cooking fluid that has been evacuated from the strainer section is withdrawn from these rows of strainers and this fluid is transported by the pump P1, and taken to a recovery process R1 or to another location in the digestion plant. It may also either or in addition be returned in the line C1 to the centre of the digester through a central pipe in order to establish a digester flow in a radial direction. Also white liquor $WL_{alt}$ may be added to this digester flow C1 in order to modify the level of alkali in the digester. Valves V1 and V2 regulate the flows R1 and C1, respectively.

Three rows of strainers $SC_{21}$, $SC_{22}$, $SC_{23}$ are located in a lower strainer section. Cooking fluid that has been evacuated from the strainer section is withdrawn from these rows of strainers and this fluid is transported by the pump P2, and taken to a recovery process R2 or to another location in the digestion plant. It may also either or in addition be returned in the line C2 to the centre of the digester through a central pipe in order to establish a digester flow in a radial direction. Valves V3 and V4 regulate the flows R2 and C2, respectively. The particular cooking technique that has been implemented in the digester determines whether the liquid that has been withdrawn is to be sent solely to R1, solely to C1, or to a combination of these.

In this prior art technology, each strainer section may have a transporting pump P1/P2 that is common for all rows of strainers, as shown in FIG. 1, or there may be a transporting pump for each row of strainers in each strainer section. Each such forwarding pump may lead liquid from one row of strainers to another position than liquid that is withdrawn from another row or from other rows of strainers in the same strainer section.

Figure 2:
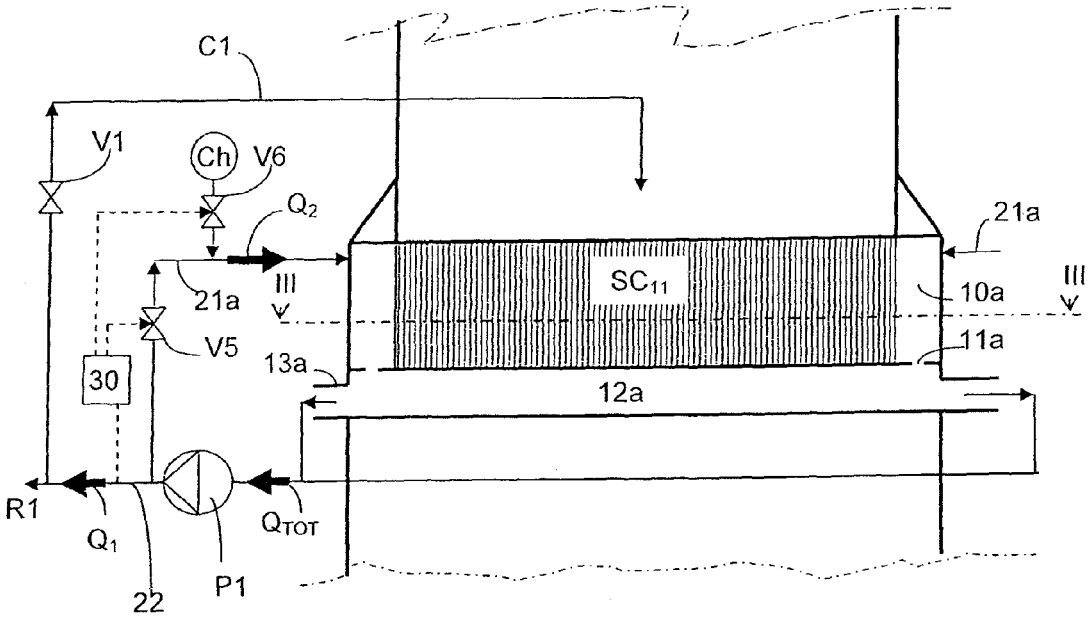
FIG. 2 shows the fundamental principle of the invention applied in a first embodiment to a row of strainers in a continuous digester.

The principles of a first embodiment of the invention are shown in FIG. 2. A strainer section in the digester with a single row of strainers $SC_{11}$ is here shown. The row of strainers has a dedicated withdrawal compartment 10*a* external to the strainers in a conventional manner, and a dedicated header 12*a* connected to the withdrawal compartment 10*a* that collects withdrawn liquid before removal from at least one of the row of strainers and the strainer section. There are, preferably, channels 11*a* between the withdrawal compartment 10*a* and the header 12*a* in a conventional manner.

Cooking fluid is withdrawn through at least one outlet tap 13*a* connected to the withdrawal compartment via the header, which cooking fluid collects in the withdrawal compartment, and a pump arrangement P1 connected to the outlet tap transports the cooking fluid away from the withdrawal compartment through the line C1 to central pipes or to another position R1.

A first end of a recirculation line 21*a* is connected to the evacuation line 22 on the pressurised side of the pump arrangement, and a second end of the recirculation line is connected to the withdrawal compartment. This recirculation line can be used to increase the rate of flow in the withdrawal compartment.

It is preferable that the outlet tap 13*a* be connected to one end of the withdrawal compartment 10*a*, here the lower part, and that the second end of the recirculation line 21*a* be connected to the second end of the withdrawal compartment, here the upper part. The complete withdrawal compartment can in this way be rinsed through with a reinforced circulation flow.

It is preferable that a regulator valve V5 be arranged in the recirculation line, which regulator valve V5 is controlled by a regulator 30 that detects a parameter that depends on the flow $Q_1$ in the evacuation line that is led to another position in the system.

It is preferable that the position in the system be the recovery process R1, in the form of storage tanks for black liquor, or to parts of the system at which the raw material is pre-treated with the withdrawn liquid, such as, for example, the black liquor impregnation process.

In the case in which the strainer section is constituted by several rows of strainers with one withdrawal compartment for each row of strainers, at least one recirculation line 21*a* is applied to each withdrawal compartment. Each recirculation line may have one or several outlets for each withdrawal compartment.

According to the invention, a supply line for additive is connected to the recirculation line 21*a*. The additive is obtained from a suitable source Ch and the flow in the supply line is regulated by a valve V6. This solution enables additive in different forms to be introduced into the flow in the recirculation line 21*a*.

Figure 3:
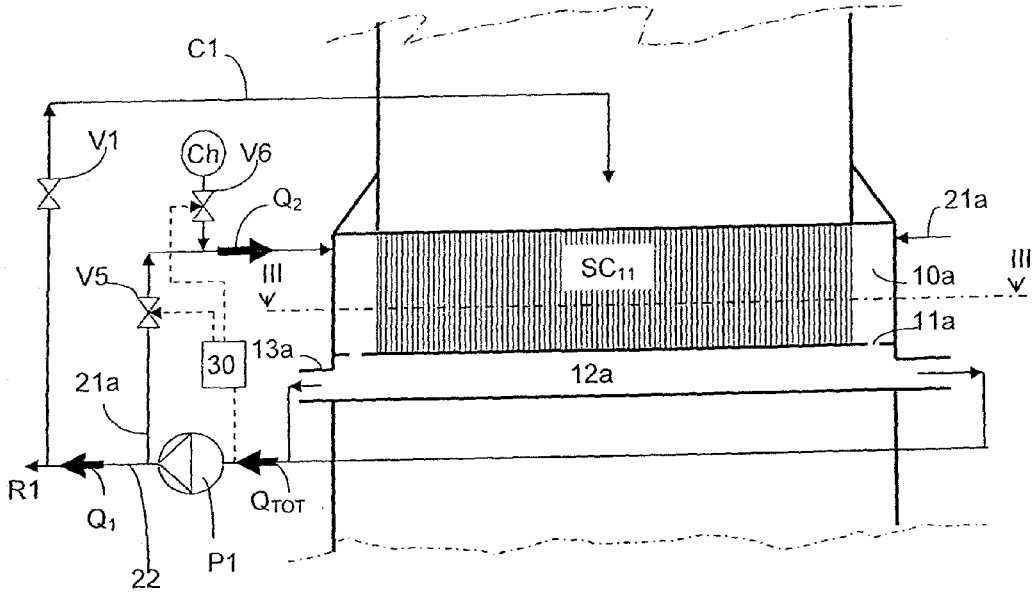
FIG. 3 shows a variant of FIG. 2 in which the withdrawal flow from the strainer is withdrawn against a lower pressure.

A variant of the embodiment in FIG. 2 is shown in FIG. 3 in which the withdrawal flow Q1 is led from a higher pressure in the digester towards a lower pressure in the system. This position in the system may preferably be the recovery process R1, in the form of storage tanks for black liquor, or to parts of the system at which the raw material is pre-treated at a lower pressure, such as, for example, the black liquor impregnation process. The fall in pressure between the digester and this position is sufficient in this case for the establishment of the flow to this position R1. It is appropriate in this embodiment that the pump P1 be moved to the recirculation line in order to ensure the establishment of the rinsing flow. The regulator valve V5 can in this case be controlled instead by the regulator 30 that detects a parameter that depends on the total flow $Q_{TOT}$ in the withdrawal flow from the header 12*a*, where this total flow is constituted by the sum of the evacuation flow $Q_1$ and the recirculation flow $Q_2$.

The regulatory function in FIGS. 2 and 3 can be used independently of the location of the pump P1, and it is determined by what is given priority or is desirable for the control of the cooking process.

The control in FIG. 2 is used if the evacuation flow $Q_1$ must be maintained at a given level, while the recirculation flow may be allowed to vary during operation of the digester. If, for example, the strainer $SC_{11}$ were to become clogged, due to, for example, scaling, the withdrawal capacity may be reduced and in this case the total flow $Q_{TOT}$ will fall and the evacuation flow $Q_1$ can for this reason be maintained at the same level, while the recirculation flow $Q_2$ can be allowed to fall. When the recirculation flow $Q_2$ subsequently falls below a minimum level, which has been pre-determined, at which the rinsing effect on the sedimentation has been reduced by too great an amount, it is necessary to clean the strainers from any scaling that is present.

The control shown in FIG. 3 is used if the evacuation flow $Q_1$ can be allowed to vary while the digester is in operation, while it is desired to maintain the total flow $Q_{TOT}$ at a predetermined level. This gives a reinforced rinsing through an increased recirculation flow $Q_2$ at times during operation of the digester at which the evacuation flow $Q_1$ falls, while the rinsing through a reduced recirculation flow $Q_2$ can temporarily be allowed to fall somewhat when the requirement for an evacuation flow $Q_1$ increases.

It is possible to allow temporary reductions of the rinsing effect with respect to the rinsing of sedimentation, since this does not normally form hard deposits: it can be rinsed away when the rinsing effect regains its full or reinforced effect. Hard deposits when they once have formed in the form of calcium carbonate and similar, known as "scaling", cannot normally be removed simply by increasing the flow: they require cleaning by the use of an active cleaning technique, such as, for example, high-pressure cleaning, and often in combination with acid-rinsing.

Figure 4:
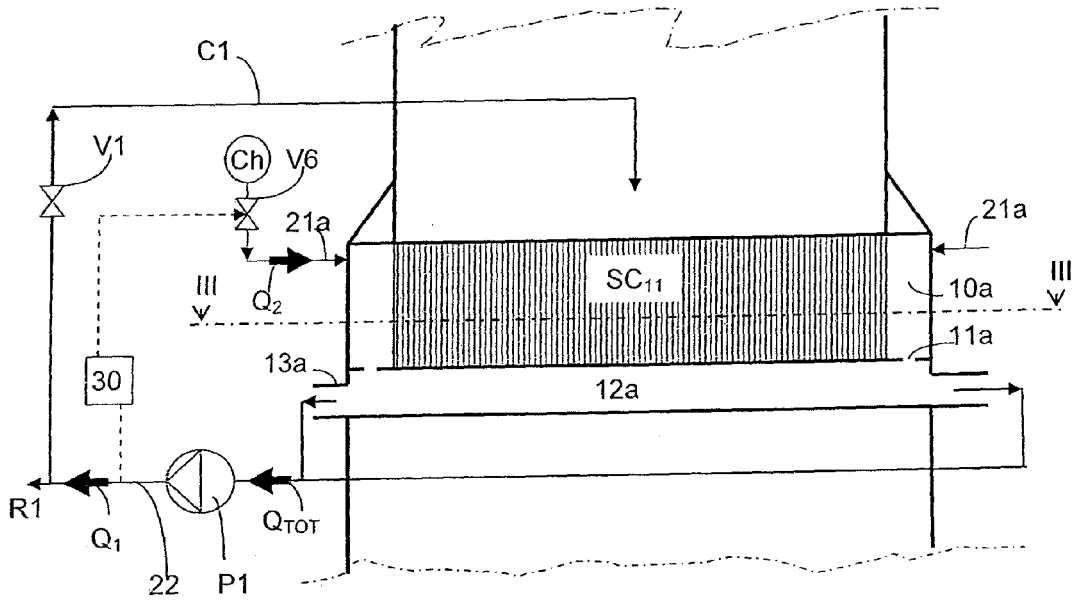
FIG. 4 shows the fundamental principle of the invention applied in a second embodiment to a row of strainers in a continuous digester.

The principles of the invention in a third embodiment are shown in principle in FIG. 4. The difference in this embodiment is that the recirculation line has been removed, and that the additive is added directly into the upper part of the withdrawal compartment 10*a*. This embodiment essentially corresponds to what has been illustrated in FIG. 2, and it functions as if the valve V5 in FIG. 2 were to be kept closed.

Figure 5:
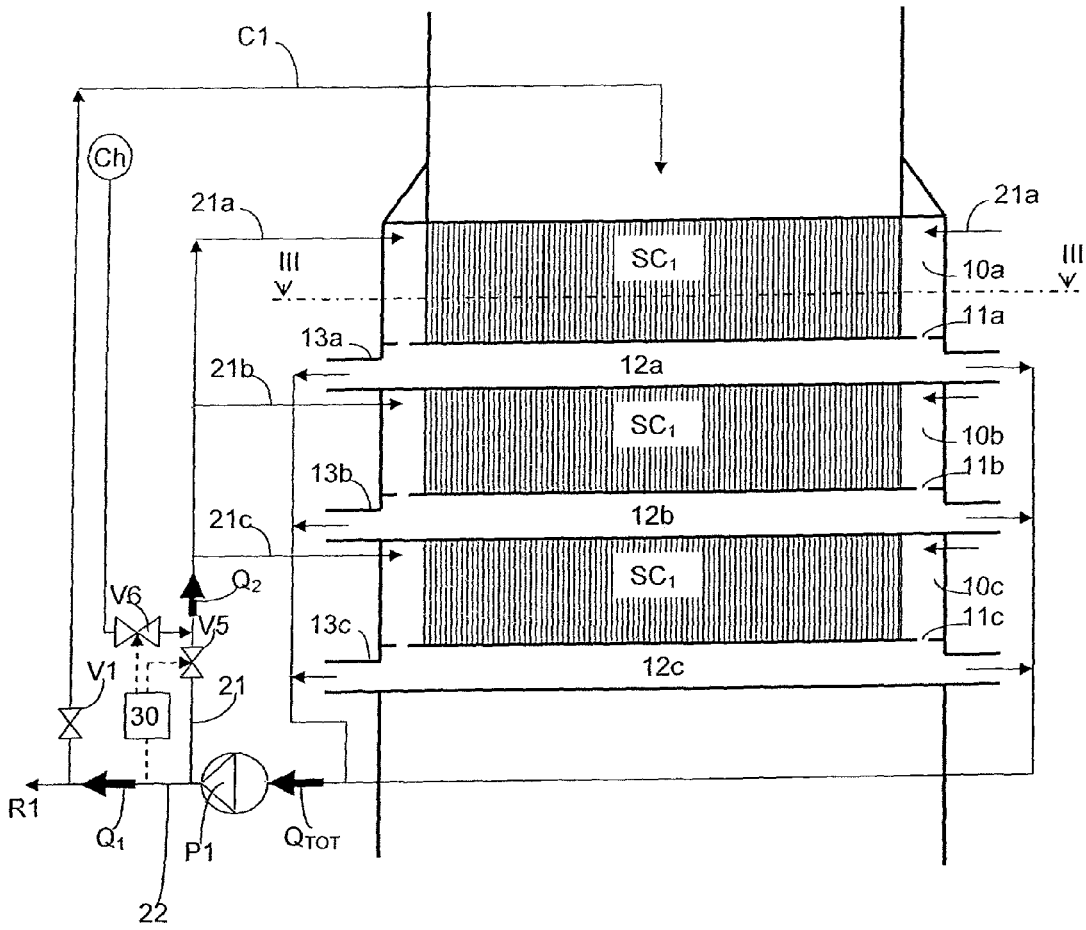
FIG. 5 shows an example of the fundamental principle of the invention applied to a strainer section in a continuous digester with several rows of strainers.

An example of how the invention can be implemented on a strainer section with several rows of strainers $SC_{11}$, $SC_{12}$, $SC_{13}$ is shown in FIG. 5. The outlet taps 13*a*, 13*b* and 13*c* are here each connected to the relevant withdrawal compartment 10*a*, 10*b*, 10*c* through the relevant header 12*a*, 12*b*, 12*c*, and cooking fluid that collects in the withdrawal compartments is withdrawn by a common pump arrangement P1 that transports the cooking fluid in a corresponding manner away from the withdrawal compartment through the line C1 either to central pipes, or to another position R1, or to both. A first end of a recirculation line 21 is connected to the evacuation line 22 on the pressurised side of the pump arrangement, and several branches 21*a*, 21*b*, 21*c* at a second end of the recirculation line are connected to the relevant withdrawal compartment, with the aim of increasing the rate of flow in the withdrawal compartment.

According to the invention, a supply line for additive is connected to the recirculation line 21. The additive is obtained from a suitable source Ch and the flow in the supply line is regulated by a valve V6. This solutions allows additive in different forms to be introduced into the flow in the recirculation line 21, and onwards to all withdrawal compartments.

Figure 6:
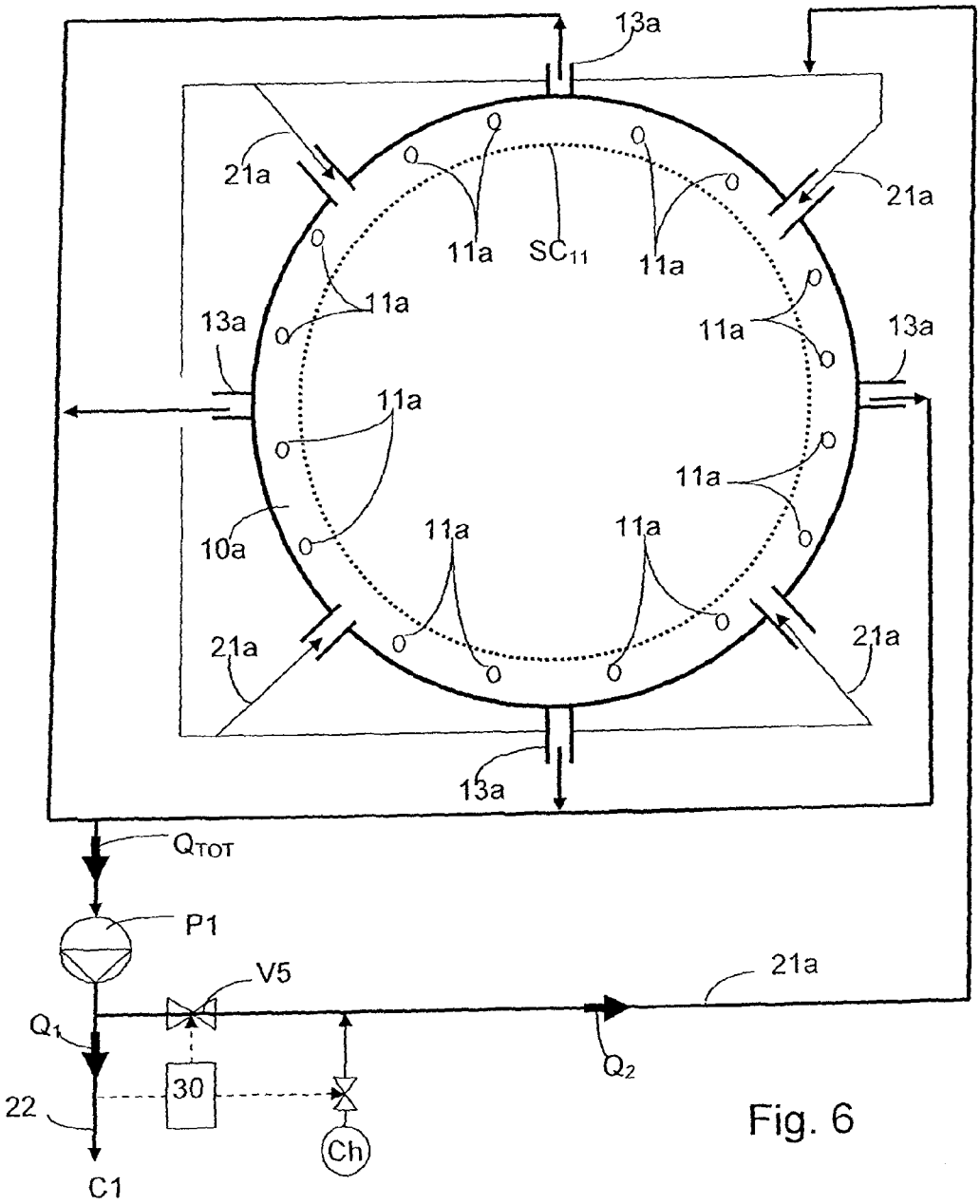
FIG. 6 shows in principle the strainer section seen from above in the digester, in a section III-III in FIGS. 2 and 4.

The strainer section in the embodiments shown in FIGS. 2-5 is shown in principal in FIG. 6 seen in a section III-III from above in the digester. The withdrawal compartment 10*a* behind the strainer surface $SC_{11}$ is revealed, and the channels 11*a* that lead down into the underlying header can be seen at its bottom. There is a large number of these channels 11*a* and 16 of them are shown in this example evenly distributed around the circumference of the bottom of the withdrawal compartment.

It is preferable that a number of outlet taps 13*a*, four are shown in this case, are connected evenly distributed around the circumference of the withdrawal compartment through the header with a distance of 90 degrees between the taps. Cooking fluid that has collected in the withdrawal compartment is withdrawn through these taps 13*a* and a pump arrangement P1 transports the cooking fluid away from the withdrawal compartment through the line 22 (to at least one of C1 and R1). A first end of a recirculation line 21*a* is connected to the evacuation line 22 on the pressurised side of the pump arrangement, and a second end of the recirculation line is connected to the withdrawal compartment, with the aim of increasing the rate of flow in the withdrawal compartment. It is preferable that the second end of the recirculation line be connected circumferentially between two outlet taps 13*a*, in order to ensure a flow throughout the complete withdrawal compartment and to avoid short-circuited flow across a small part of the compartment.

It is preferable that a regulator valve V5 be arranged in the recirculation line 21*a*, which regulator valve V5 is controlled by a regulator 30 that detects a parameter that depends on the flow in the evacuation line 22.

According to the invention, a supply line for additive is connected to the recirculation line 21*a*. The additive is obtained from a suitable source Ch and the flow in the supply line is regulated by a valve V6. This solution enables additive in different forms to be introduced into the flow in the recirculation line 21*a*.

Common for all of the embodiments shown in FIGS. 2-6 is that the additive is added directly into the withdrawal compartment and counteracts precipitation processes in the withdrawal compartment while the cooking fluid is being withdrawn from the withdrawal compartment.

The additive can be distinguished from the liquid that is withdrawn at the strainer section, and differs from this withdrawal liquid with respect to at least one of temperature and chemical composition, depending on whether the precipitation takes place as a result of temperature, chemical reactions, or both.

It is preferable that an additive be used that influences when added the pH value in the withdrawal compartment such that this is increased to at least a value of 10, preferably at least a value of 11. It is possible in this way to prevent precipitation of lignin if acid pre-hydrolysate and black liquor are mixed into the withdrawal compartment.

The additive may be constituted fully or partially also by added steam, or the additive may be subject to heating before it is added. It is also possible that both of these processes be used.

The additive may principally consist of, at a level of at least 50%, white liquor, black liquor or alkaline filtrate from a subsequent bleaching plant.

The additive that is shown in FIGS. 2, 3, 5 and 6 is added to a second subsidiary flow $Q_2$ of the total flow $Q_{TOT}$ that is withdrawn from the outlet tap, which second subsidiary flow is returned directly to the withdrawal compartment. A first subsidiary flow $Q_1$ of the total flow $Q_{TOT}$ that is withdrawn from the outlet tap is led away from the strainer construction.

The activation of the second subsidiary flow $Q_2$ is activated at least on regular occasions during the continuous operation of the digester when clogging in the withdrawal compartment is to be counteracted. It is, however, preferable that the method be continuously activated during operation of the continuous digester.

The total flow $Q_{TOT}$ is withdrawn in FIGS. 2-6 from the lower part of the withdrawal compartment and that the additive in FIGS. 2, 3, 5 and 6 together with the second subsidiary flow $Q_2$ of the total flow is introduced to the upper part of the withdrawal compartment.

The addition of the additive, preferably together with the second subsidiary flow $Q_2$, is regulated in a manner that depends on a parameter that indicates the flow or the pH value of the first subsidiary flow $Q_1$.

It is preferable that the flow in the strainer construction for a continuous digester be regulated such that a total flow $Q_{TOT}$ is withdrawn from the withdrawal compartment through the outlet tap and the pump arrangement, where a first subsidiary flow $Q_1$ of the total flow is led away from the strainer construction and a second subsidiary flow $Q_2$ of the total flow is returned with the additive to the withdrawal compartment, such that the flow in the withdrawal compartment increases by at least 50% relative to the rate of flow that would otherwise be established in this withdrawal compartment if the total flow $Q_{TOT}$ was solely constituted by the first subsidiary flow $Q_1$ that has been evacuated from the strainer construction.

In order to ensure through-rinsing of the complete withdrawal compartment the total flow $Q_{TOT}$ is taken, in this method, from the lower part of the withdrawal compartment; while the second subsidiary flow $Q_2$ of the total flow with the additive is returned to the upper part of the withdrawal compartment. It is possible in this manner to drain away also heavy particles, sediment and collections of fibres that are deposited in the lower parts of the withdrawal compartment.

In one preferred embodiment of the method according to the invention, the flow is regulated by the second subsidiary flow $Q_2$, depending on a parameter that indicates the flow of the first subsidiary flow $Q_1$. The first subsidiary flow is determined by the cooking process that it is desired to establish in the digester, and where a lower limit for the flow is desirable in order to maintain the cooking conditions prevalent in the process. If and when the flow indicates that the amounts withdrawn are starting to fall, due to, for example, clogging of the withdrawal compartment, activation of the second subsidiary flow $Q_2$ can take place.

The invention is not limited to the embodiments specified above: several variants are possible within the scope of the attached patent claims.

It is possible, for example, for a strainer section with several rows of strainers, as shown in FIG. 5, to have an individual pump arrangement P1, an individual recirculation line 21, and individual control of these. In the event of activated or reinforced rinsing of a withdrawal compartment, the flow R1/C1 to the relevant header can be closed down, and the complete flow can be returned to the recirculation line 21 such that $Q_{TOT}$ becomes equivalent to the second subsidiary flow $Q_2$.

The magnitude of the flow in the second subsidiary flow $Q_2$ with the additive can be regulated such that it lies in the interval 20% to 100% of $Q_{TOT}$, where a lower level is used during continuous operation and where a forced higher level is activated when necessary or at certain pre-determined times.

EXAMPLE OF IMPLEMENTATION

A strainer section with three rows of strainers is located on a digester that has a radius of 4 meters, where each withdrawal compartment in a row of strainers has a height of 1110 mm and a radial extent of 120 mm. The volume of the withdrawal compartment then will be:

$$V=1110*\pi*(4000^2-3880^2)=3{,}295{,}794 \text{ liters, i.e. approximately 3.3 cubic meters.}$$

The strainer section, with all three rows of strainers, has been dimensioned to withdraw approximately 111 l/s, with a maximum flow of 143 l/s. These flows correspond to 339.6 and 514.8 $m^3$/h, respectively.

The flow from each row of strainers then will be:

$$Q_{TOT}/\text{row of strainers}_{norm}=(339.6/3)=113.2\ m^3/h$$

$$Q_{TOT}/\text{row of strainers}_{max}=(514.8/3)=171.6\ m^3/h$$

The rate of turnover for the liquid in the withdrawal compartment will be (113.2/3.3)=34 times per hour. This corresponds to the liquid being exchanged after approximately 105 seconds.

It is preferable that the rate of flow in the withdrawal compartment be increased by at least 50%. By maintaining a first subsidiary flow Q1 that is led away from the strainer construction (to C1/R1) at the same level of 37 l/s while adding a second subsidiary flow $Q_2$ of just over 18 l/s that is returned to the withdrawal compartment, the total flow $Q_{TOT}$ that is withdrawn through the outlet tap and the pump arrangement is increased, while the cooking process is not influenced. The rate of flow in the withdrawal compartment is increased in this manner by 50%, and the turnover time is reduced from 105 seconds to 70 seconds, and the risk of sedimentation is reduced.

The following changes can be obtained in this type of strainer construction by successively increasing $Q_2$ while retaining $Q_1$ at its same value:

| $Q_1$ l/s | $Q_2$ l/s | $Q_{TOT}$ l/s | Δ rate of flow | Turnover time |
|---|---|---|---|---|
| 37 | 0 | 37 | 0 | 105 seconds |
| 37 | 18 | 55 | 50% | 70 seconds |
| 37 | 37 | 74 | 100% | 53 seconds |
| 37 | 74 | 111 | 200% | 35 seconds |

The increase in $Q_2$ does not influence the cooking process, since only the flow $Q_1$ is withdrawn from the strainer section, while $Q_1$ is solely an internally recycled flow in the strainer construction that maintains the function of the withdrawal compartment.

The quantity of the additive can correspond to 50-100% of $Q_2$, where the embodiment shown in FIG. 3 corresponds to a situation in which the additive corresponds to 100% of $Q_2$.

While the present invention has been described in accordance with preferred compositions and embodiments, it is to be understood that certain substitutions and alterations may be made thereto without departing from the spirit and scope of the following claims.

The invention claimed is:

1. A method for preventing clogging in a strainer construction for a continuous digester, comprising:

providing a withdrawal strainer disposed inside the digester, a withdrawal compartment disposed between the withdrawal strainer and an outer wall of the digester, and an outlet tap in fluid communication with the withdrawal compartment, the withdrawal strainer withdrawing a cooking fluid from a column of pulp in the digester, collecting the cooking fluid in the withdrawal compartment disposed inside the outer wall of the digester, the outlet tap withdrawing the cooking fluid, an evacuation line, in fluid communication with the outlet tap, transferring the cooking fluid away from the outlet tap, adding an additive directly to the withdrawal compartment, and the additive counteracting a precipitation processes in the withdrawal compartment while withdrawing the cooking fluid and the added additive from the withdrawal compartment;

wherein the additive is added to a second subsidiary flow of a total flow that is withdrawn from the outlet tap, the second subsidiary flow is returned directly to the withdrawal compartment, and the second subsidiary flow is less than or equal to the total flow; and wherein the total flow is withdrawn from one end of the withdrawal compartment, and the additive is introduced into a second end of the withdrawal compartment.

2. The method according to claim 1, wherein a first subsidiary flow of the total flow that has been withdrawn from the outlet tap is led away from the strainer construction, the total flow is constituted by a sum of the first subsidiary flow and the second subsidiary flow.

3. The method according to claim 1, wherein the second subsidiary flow is activated on regular occasions during a continuous operation of the digester when clogging in the withdrawal compartment is to be counteracted.

4. The method according to claim 1, wherein the addition of the additive, is regulated in a manner that depends on a parameter that indicates a flow or a pH value of the first subsidiary flow.

5. The method according to claim 1 wherein the additive influences a pH value in the withdrawal compartment such that the pH value is raised to at least a value of 10.

6. The method according to claim 5, wherein the additive is principally composed of white liquor.

7. The method according to claim 5, wherein the additive is principally composed of black liquor.

8. The method according to claim 5, wherein the additive is principally composed of an alkaline filtrate from a subsequent bleaching plant.

9. The method according to claim 1 wherein the additive is hotter than the cooking fluid in the withdrawal compartment, and the additive is fully or partially composed of steam.

10. The method according to according to claim 1 wherein the additive is principally composed of chemicals that prevent a precipitation of chemical deposits.

* * * * *